US008240269B2

(12) United States Patent
Duffield

(10) Patent No.: US 8,240,269 B2
(45) **Date of Patent: *Aug. 14, 2012**

(54) BOAT WINDOW SYSTEM

(75) Inventor: Marshall Duffield, Newport Beach, CA (US)

(73) Assignee: Duffield Marine, Inc., Costa Mesa, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/024,254

(22) Filed: Feb. 9, 2011

(65) Prior Publication Data

US 2011/0126754 A1 Jun. 2, 2011

Related U.S. Application Data

(63) Continuation of application No. 12/258,134, filed on Oct. 24, 2008, now abandoned, which is a continuation of application No. 12/011,838, filed on Jan. 30, 2008, now Pat. No. 7,506,605, which is a continuation of application No. 11/103,382, filed on Apr. 11, 2005, now Pat. No. 7,415,938.

(51) Int. Cl.
*B63B 35/50* (2006.01)

(52) U.S. Cl. ..... 114/361

(58) Field of Classification Search ..... 114/343, 114/361; 296/77.1, 145, 146.1; 135/88.01
See application file for complete search history.

(56) References Cited

U.S. PATENT DOCUMENTS

| | | | | |
|---|---|---|---|---|
| 2,459,026 | A * | 1/1949 | Hardy | 296/161 |
| 2,505,520 | A | 4/1950 | Bills | |
| 3,978,535 | A | 9/1976 | Swan et al. | |
| 5,027,739 | A | 7/1991 | Lackovic | |
| 5,092,262 | A | 3/1992 | Lacy | |
| 5,121,703 | A | 6/1992 | Smith | |
| 5,325,807 | A * | 7/1994 | Hidekura | 114/361 |
| 5,472,771 | A | 12/1995 | Sofie et al. | |
| 5,660,916 | A | 8/1997 | Sofie et al. | |
| 5,851,637 | A | 12/1998 | Sofie et al. | |

* cited by examiner

*Primary Examiner* — Daniel Venne
(74) *Attorney, Agent, or Firm* — Stetina Brunda Garred & Brucker

(57) ABSTRACT

A cabin enclosure of a boat which is substantially water proof is provided. The cabin enclosure comprises a top, frame with joists attached to joist covers, plurality of windows, flashing and track which are layered upon each other to cascade water down the top, onto the windows and onto the track and into the river, bay or ocean. The plurality of windows may surround the passenger area of the boat and also prevents water from entering the boat. In particular, the plurality of windows are zippered onto adjacent joist covers so as to form a substantially water proof barrier between the interior and exterior of the boat. The flashing may be attached to the interior of the window with hooks and loops which run horizontally across the window and prevent water that splashes under the window from entering into the passenger area.

3 Claims, 4 Drawing Sheets

BOAT WINDOW SYSTEM

CROSS-REFERENCE TO RELATED APPLICATIONS

The present application is a continuation patent application of U.S. patent application Ser. No. 12/258,134, filed on Oct. 24, 2008 now abandoned which is a continuation of U.S. patent application Ser. No. 12/011,838 filed on Jan. 30, 2008, now U.S. Pat. No. 7,506,605 issued on Mar. 24, 2009, which is a continuation of U.S. patent application Ser. No. 11/103,382 filed on Apr. 11, 2005, now U.S. Pat. No. 7,415,938 issued on Aug. 25, 2008, the entire contents of which are incorporated herein by reference.

STATEMENT RE: FEDERALLY SPONSORED RESEARCH/DEVELOPMENT

Not Applicable

BACKGROUND OF THE INVENTION

The present invention relates generally to windows, and more particularly, to window systems for boats.

Boats by their very nature are subject to wet conditions. For example, water will splash into a boat as it cruises through a bay or river. Also, the boat may become wet due to rain water. Although the exterior of the boat is designed for wet conditions, to a lesser extent, its interior may not be designed for wet conditions. For example, electronic equipment in the boat passenger area may not be designed for wet conditions. Also, higher end boats such as boats sold by Duffy Electric Boat Company of Newport Beach, Calif. may have leather seating within the passenger area which may become damaged upon wetting. Additionally, boat passengers may want to stay dry while riding the boat. To this end, prior art window systems have been designed to cover the passenger areas such that the passenger area and the passengers do not get wet from water splashes and rain fall while cruising through the bay or river.

For example, one prior art window system has a plurality of window openings surrounding the passenger area of the boat. Each window opening receives a window which is fabricated from a clear transparent material such that the passengers may look through the window to view the scenery as the boat is cruising through the bay or river. The window openings and the windows form a barrier between the outside environment and the interior of the passenger area. In particular, the window is formed from a transparent material and its peripheral edges bonded to a fabric. The fabric's peripheral edges are attached to a zipper which mates to a mating zipper attached to the window openings. By this way, zippering the zippers attaches the windows to the window openings and prevents water from entering the boat.

Unfortunately, the bonding process is expensive and adds to the cost of fabricating prior art window systems.

BRIEF SUMMARY OF THE INVENTION

The present invention addresses the deficiencies in the prior art. In an aspect of the present invention, a window system is provided which may provide a substantially water proof barrier from water splashes and rain water that is less expensive compared to prior art window systems. The window system may comprise a plurality of joists, headers and beams which collectively form a frame of the window system. The frame is attachable to the boat and is sized to fit about and over the passenger area of the boat.

A top may rest on the frame such that boat passengers are protected from the sun. Also, the top may direct rain water away from the passenger area and into the water (e.g., bay, river, or ocean). In particular, the top may be fabricated from a water proof material or fabric which extends or entirely covers the passenger area. Since the top entirely covers the passenger area, rain water may fall on the top and slide off the top into the water. The rain may further be urged off the top by bowing the beams upwardly from the center such that top has a dome configuration over the passenger area. The dome configuration urges the rain to run towards the sides of the boat and since the top covers the entire passenger area, the rain falls into the water.

The window system may also prevent water from wetting the passenger area by placing a plurality of windows about the periphery of the passenger area. More particularly, the plurality of windows forms a barrier between the interior (i.e., passenger area) and the exterior of the boat. The windows may be hung from the headers of the frame via retaining loops looped onto the header and attached to the window. The windows may be connected to each other by zippers. In particular, the windows may be inserted into window openings formed by respective joists covered by joist covers and headers. One window may hang within each window opening. Each side of the window may be attached to a first row of teeth of a zipper. Each adjacent joist cover may be attached to a complementary second row of teeth of the zipper. The second row of teeth may engage the first row of teeth to prevent water from passing through between the windows and the window openings. For example, when rain falls onto the top, the rain is urged outwardly and cascades down the windows and joist covers into the water. Also, when water splashes onto the windows, the windows and joist covers repel the water from the passenger area. The zippers prevent water from seeping into the passenger area between adjacent windows and window openings.

The zippers may be sown onto each of the windows. In particular, each window may be fabricated from a transparent material and its periphery or border interposed between an interior layer and an exterior layer. The interior and exterior layers may be sown onto the transparent material. Additionally, a base of the first row of teeth may be interposed between the interior and exterior layers and sown thereto. Preferably, a first row of teeth is attached to each side of the window. Furthermore, the joists which form the frame may be attached to joist covers. Also, a complementary second row of teeth may be attached (e.g., sown) to a joist cover adjacent the window sides. Accordingly, when the enclosure is assembled, the first row of teethes attached to the windows are engaged to the second row of teethes attached to adjacent joist covers to form a water proof barrier between the interior and exterior of the boat.

The enclosure may also comprise a flashing and track to prevent water from splashing into the boat under the window. The flashing is attachable to both the window and the track. The flashing may be attached to the interior of window with complementary hooks and loops. These hooks and loops may be attached along the entire horizontal direction of the window such that water that splashes under the window is prevented from entering the passenger area by the hooks and loops. The track may be attached to the boat about the perimeter of the boat passenger area. The flashing and track urges water away from the passenger area. In particular, water that cascades down the windows and joist covers also cascade down the flashing and track into the river, bay or ocean. Accordingly, the top, windows, joist covers, flashing and track are layered such that water is directed toward the outer perimeter of the passenger area much like layered tiles of a roof.

BRIEF DESCRIPTION OF THE DRAWINGS

An illustrative and presently preferred embodiment of the invention is shown in the accompanying drawings in which.

DETAILED DESCRIPTION OF THE INVENTION

Figure 1:
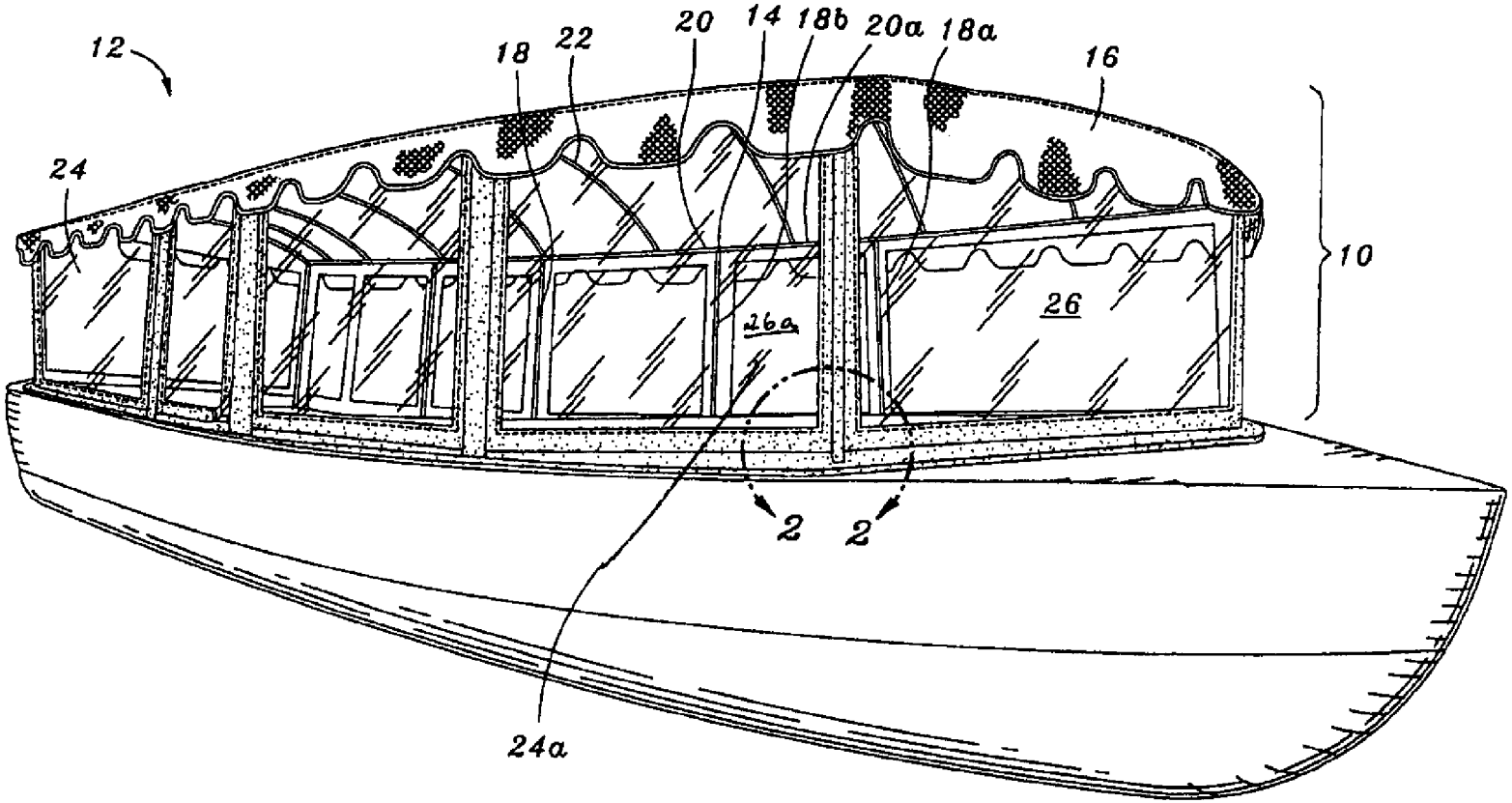
FIG. 1 is a perspective view of a boat with a cabin enclosure.

Referring now to FIG. 1, an aspect of the present invention relates to a cabin enclosure 10 of a boat 12. The cabin enclosure 10 allows the passengers to view the surrounding scenery while the boat 12 cruises through a bay, channel or ocean. As the boat 12 travels through the water, water tends to splash upward and into the boat 12. Fortunately, the cabin enclosure 10 also prevents the water from entering into the boat to keep the passenger area and its passengers dry. In addition, the cabin enclosure 10 prevents rain water from entering the boat 12 by directing the rain water over the cabin enclosure 10, away from the passenger area and into the water. Hence, the cabin enclosure 10 may be effective in preventing water from entering the boat 12 whether it is from splashing water or rain water, yet allow its passengers to enjoy the surrounding scenery.

The cabin enclosure 10 may comprise a frame 14 and a top 16 resting on the upper portion of the frame 14. The frame 14 may be formed collectively by a plurality of joists 18, headers 20 and beams 22, and the top 16 may rest on the beams 22, as shown in FIG. 1. The frame 14 may also define a plurality of window openings 24 which allow the boat passengers to view the surrounding scenery. The window opening 24 is the opening formed by respective adjacent joists 18 (see FIGS. 1 and 4) covered by joist covers 19 (see FIG. 4) and header 20 (see FIGS. 1 and 4). For example, joists 18*a, b* (see FIGS. 1 and 4), joist covers 19*a, b* (see FIG. 4) and header 20*a* (see FIGS. 1 and 4) form window opening 24*a* (see FIGS. 1 and 4). Since the window openings 24, if left open or uncovered would allow water to splash into the boat 12 and also allow rain water to enter the boat 12, a window 26 may further be attached to the window opening 24. For example, window 26*a* may cover the window opening 24*a* to prevent any water from entering the boat passenger area and may be fabricated from a transparent material to still allow the boat passengers to view the surrounding scenery. Thus, the cabin enclosure 10 allows the passengers to view the surrounding scenery and remain dry during the boat ride.

The plurality of joists 18 may be removeably attachable to the boat 12 along a forward, aft, port and starboard sides of the passenger area of the boat 12. These joists 18 may extend vertically upward such that the passengers may comfortably stand up within the passenger area without bumping into the cabin enclosure top 16. The plurality of beams 22 may be attached to the joists 18 and/or header 20 and extend over the passenger area. The cabin enclosure top 16 may rest on top of the plurality of beams 22, as shown in FIG. 1, to provide the boat passengers shelter from the sun and rain fall. The cabin enclosure top 16 may be fabricated from a substantially water proof or water resistant material. By way of example and not limitation, the top 16 may be fabricated from a vinyl material, fabric material, plastic material, SUNBRELLA fabric, SUNBRELLA acrylic canvas, STAMOID vinyl or other flexible material.

Figure 4:
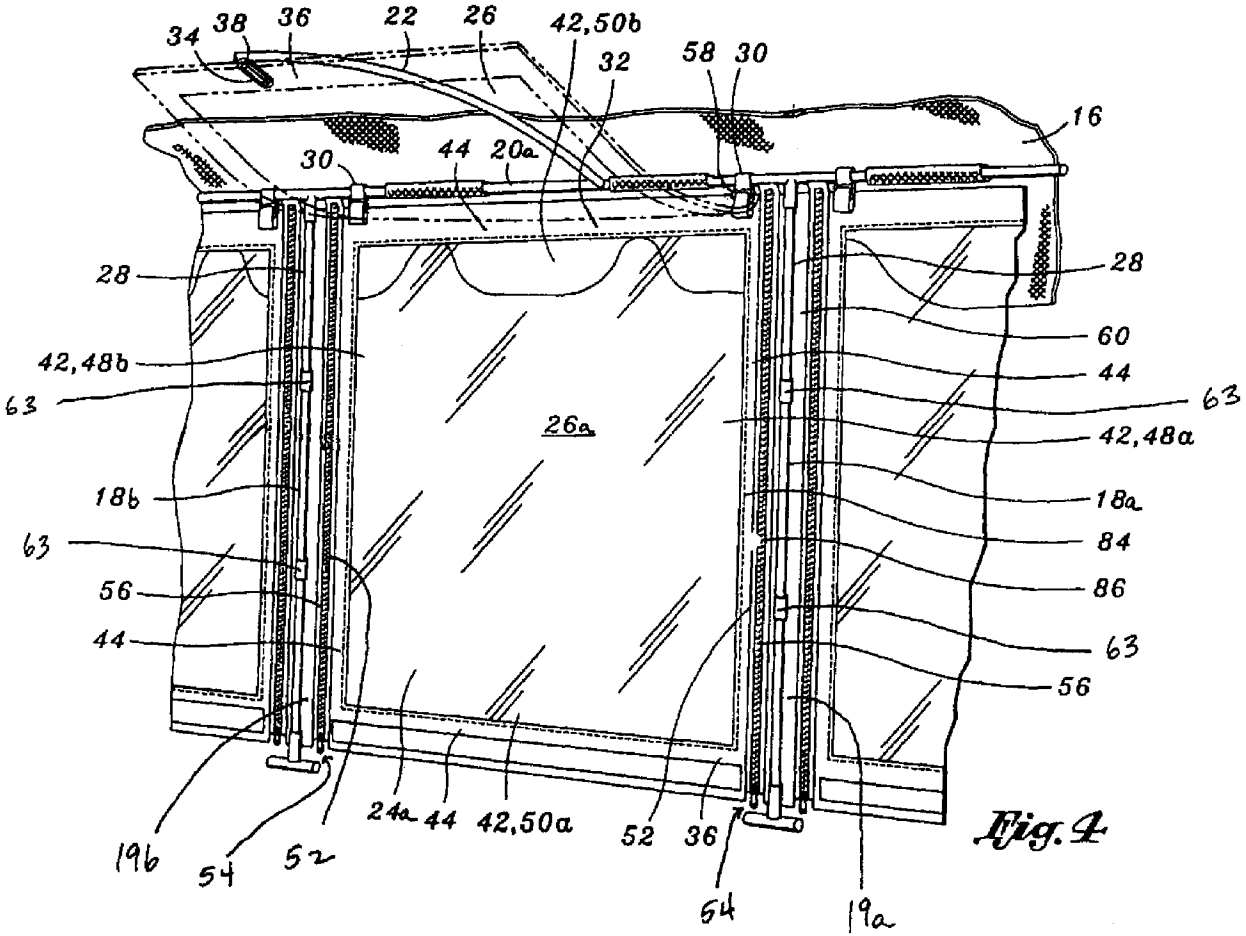
FIG. 4 is a perspective view of a window and window opening of FIG. 1.

The joists 18 at its upper ends may be connected to each other with a header 20. For example, as shown in FIG. 4, joists 18*a, b* are connected to each other with header 20*a*. The header 20, two adjacent joists 18 and joist covers 19 may define the window opening 24 and the window 26 is removeably attachable to the window opening 24. The window 26 may have at least two retaining loops 30 attached to an upper rail 32 of the window and looped onto the header 20. Since, preferably, the header 20 is fabricated from a circular tubular material such as 316 stainless steel tubing, the window 26 may rotate inwardly to an opened position from the closed position, as shown in FIG. 4. In FIG. 4, the solid lines show the window 26 in the closed position, and the dashed lines show the window 26 in the opened position. The window 26 may be locked into the opened position via a bungee cord 34 attached to the lower rail 36 of the window 26 and a button 38 attached to the beam 22 (i.e., underside of frame 14).

The window 26 may be fabricated from a transparent sheet 40 (see FIGS. 3 and 3*a*) such that the passengers may still view the surrounding scenery when the window 26 is in the closed position. The transparent sheet 40 may be about 0.080 inches thick. By way of example and not limitation, the transparent sheet 40 may be plastic material, polycarbonate material, MAKROLON polycarbonate sheet or Strataglass. The transparent sheet 40 may be silicate coated to prevent yellowing and wrinkling. Also, the transparent sheet 40 may be UV coated to block UV rays from passing through the sheet. There is no size limitation of the window 26 because, as will be discussed further below, the window 26 is sown together. Accordingly, the present invention contemplates windows 26 larger than five feet by eight feet.

Figure 2:
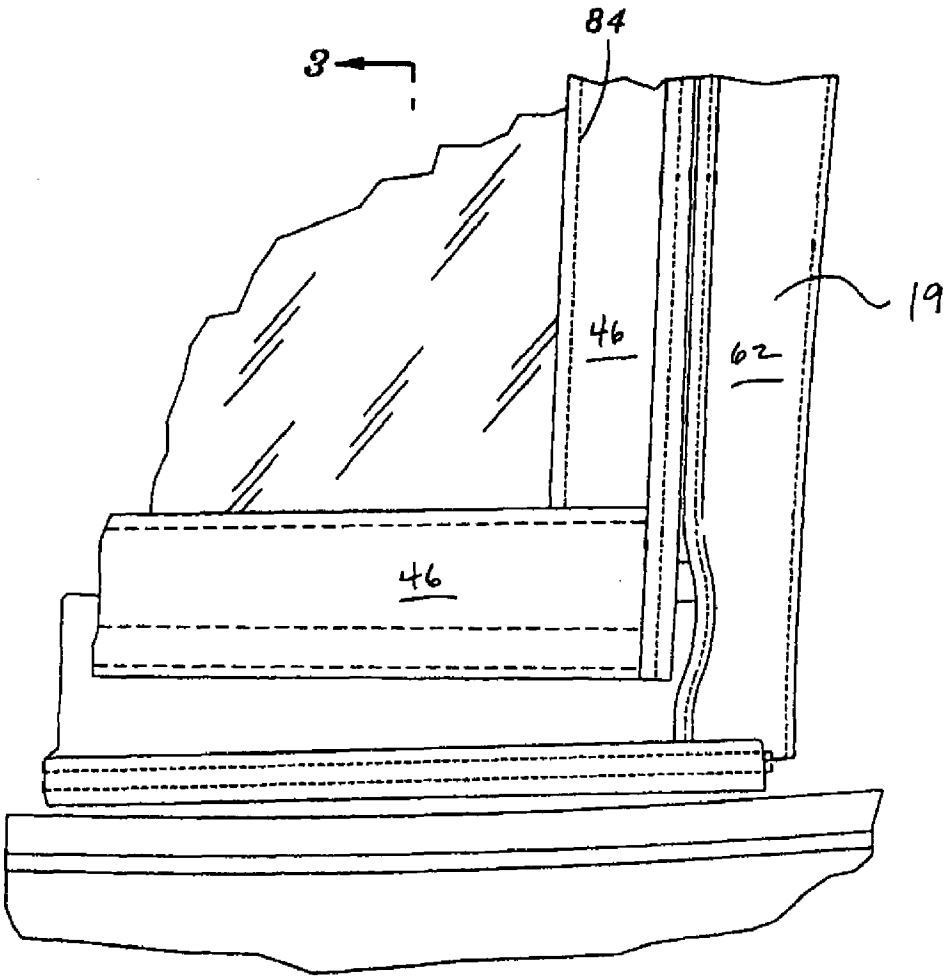
FIG. 2 is a sectional view of the cabin enclosure of FIG. 1.

The border or periphery 42 (see FIG. 4) of the sheet 40 may be sown to a plurality of respective inner layers 44 (see FIG. 4) and outer layers 46 (see FIG. 2). By way of example and not limitation, the layers 44, 46 may be fabricated from a vinyl material, fabric material, plastic material, SUNBRELLA fabric, SUNBRELLA acrylic canvas, STAMOID vinyl, nylon or other flexible material. The border 42 of the sheet 40 may define two vertical edge portions 48*a, b* and two horizontal edge portions 50*a, b* with each edge portion 48*a*, 48*b*, 50*a*, 50*b* having sown thereto an inner layer 44 and an outer layer 46 (see FIGS. 2-4). The inner and outer layers 44, 46 that are attached to each of the two vertical edge portions 48*a, b* may also be attached (e.g., sown) to a first row of teeth 52 of a zipper 54 and a mating second row of teeth 56 may be attached to joist covers 19*a, b* attached to immediately adjacent joists 18*a, b* (see FIG. 4). When the first row of teeth 52 mates with respective second row of teeth 56, a substantially water proof barrier is formed between the window 26 and the adjacent joist covers 19. As such, a plurality of windows 26 may be disposed within the window openings 24 and connected to adjacent joist covers 19 as described above such that there is a substantially water proof barrier between the interior and the exterior surrounding the passenger area of the boat 12.

The inner layer 44 and the upper layer 46 attached to the horizontal edge portion 50*b* may be attached to the retaining loops 30, as shown in FIG. 4. These loops 30 may be hooks and loops (i.e., VELCRO) and preferably, the loops 30 may be looped around the header 20, through a turnbuckle 58 and attached onto the hooks to hold the window 26 onto the header 20. In other words, the window 26 may hang vertically downward from the header 20 via the retaining loops 30 to the closed position. In the closed position, the window 26 may be interposed between adjacent joists 18, joist covers 19 and under the header 20 (i.e., inserted within the window opening 24).

As stated above, the window 26 may be rotated about the header 20 inwardly into the passenger area of the boat 12. The window 26 may be pushed toward the beams 22 extending across the passenger area and may be attached to such beams 22 (see FIG. 4). More particularly, buttons 38 may be attached to the underside of the beams 22 and the window 26 may have elastic cords 34 (e.g., bungee cord) attached to the lower rail 36. The elastic cord 34 may be wrapped around the button 38 to hold the window 26 in this upward or opened position.

The top 16, as stated above, may rest on top of the frame 14. More particularly, the top 16 may rest on top of the beams 22 and extend past the headers 20, as shown in FIG. 4. Since the top 16 may be fabricated from a flexible material, the top 16 may fold over the header 20 adjacent the exterior side of the window 26 below or adjacent the upper rail 32 such that rain water or water falling onto the top 16 may slide down toward the aft, forward, port and starboard sides of the boat 12 and cascade down the plurality of windows 26 and joist covers 19 about the boat passenger area. The beams extending across the passenger area may also be bowed upwardly to help water falling on the top 16 to slide to the port and starboard sides of the boat 12. Additionally, zippers 54 attached to the windows and joist covers 19 prevent water from entering the boat 12 through the gap between the window 26 and window opening 24.

The joist 18 may be attached to the joist cover 19. In particular, the joist cover 19 may comprise a joist inner layer 60 (see FIG. 4) and a joist outer layer 62 (see FIG. 2). The joist cover 19 may be attached to the joist 18 through sleeves 63 (see FIG. 4). The inner and outer layers 60, 62 may vertically extend the length of the respective joist 18 such that water sliding off of the top 16 cascades down the joist outer layer 62 to keep the passenger area dry. Mating second row of teethes 56 of the zipper may be sown onto the left or right sides of the joist inner and outer layers 60, 62 adjacent the windows 26. The second row of teeth 56 may mate with the respective first row of teeth 52 to provide a substantially water proof passenger area such that water splashes and rain fall does not enter the boat 12.

Figure 3:
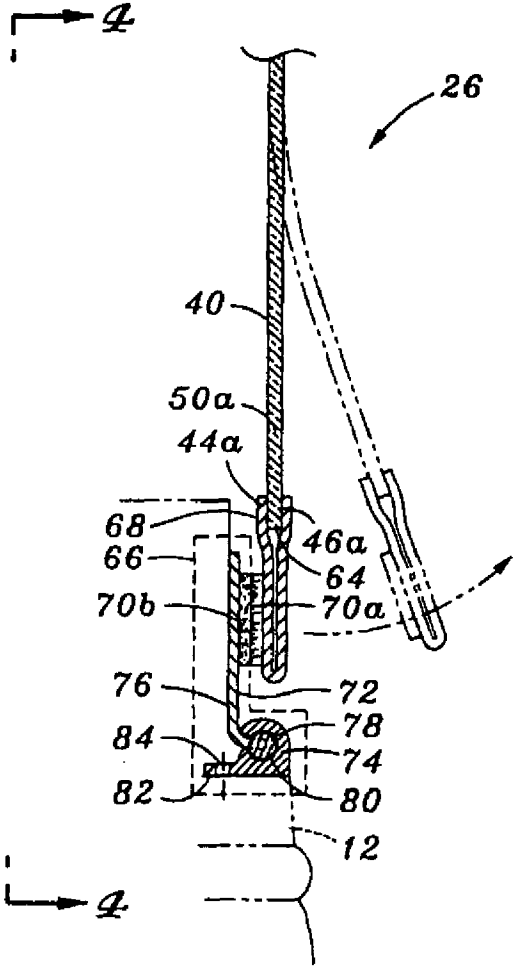
FIG. 3 is a cross sectional view of a window and track of the cabin enclosure of FIG. 1 wherein a receiving cavity of the track is directed inward toward the passenger area.
Figure 3A:
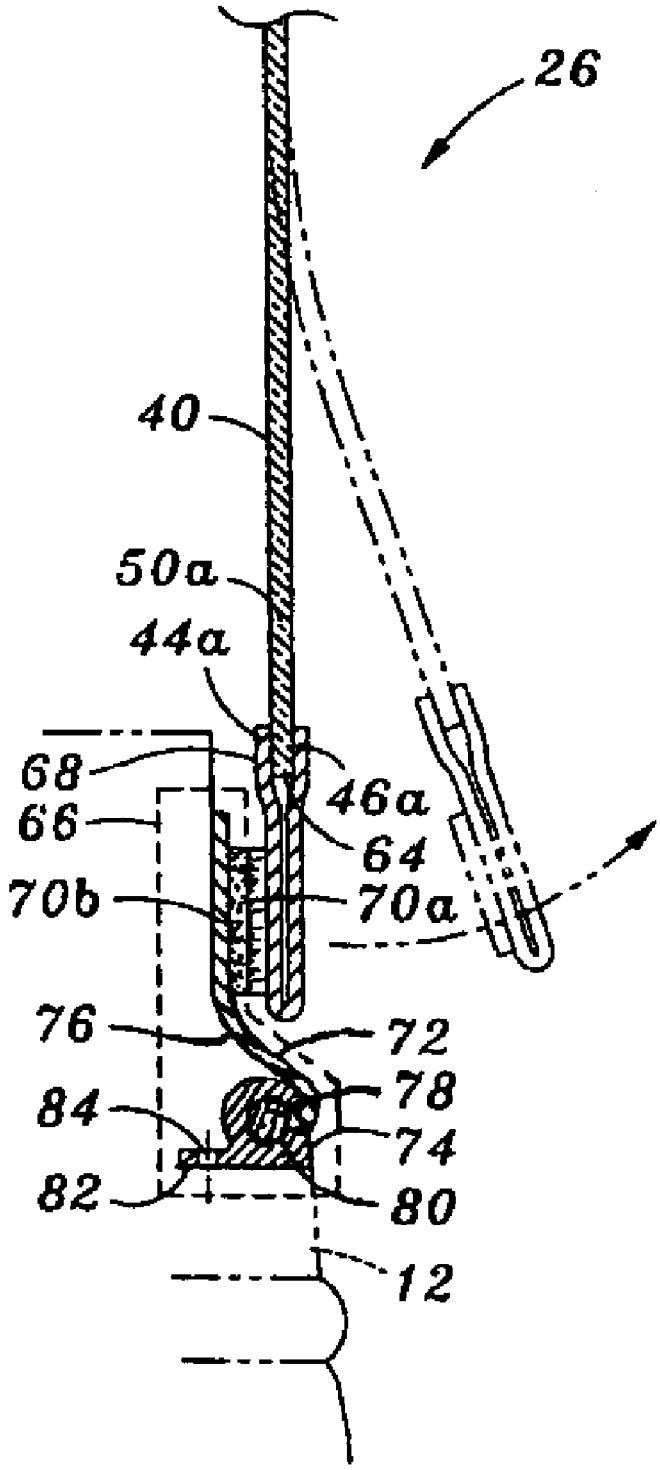
FIG. 3*a* is a cross sectional view of a window and track of the cabin enclosure wherein the receiving cavity of the track is directed away from the passenger area.

The lower edge portion 50*a* of the sheet 40 may be interposed between the inner layer 44*a* and the outer layer 46*a* and sown thereto, as shown in FIGS. 3 and 3*a*. Such inner and outer layers 44*a*, 46*a* may extend from the lower edge 64 of the sheet 40 past a water guard 66 (see FIGS. 3 and 3*a*) which is attached to the boat 12. The interior side 68 of the inner layer 44*a* may have attached thereto hooks and loops (i.e., VELCRO) 70*a* extending across the entire horizontal length of the inner layer 44*a*. The hooks and loops 70*a* may be engaged to complimentary hooks and loops 70*b* attached to an exterior side 72 of the water guard 66. Accordingly, water that runs down the window 26 may cascade onto the water guard 66 and eventually into the ocean, river or bay to keep the passenger area and the passengers dry. Further, water that splashes under the inner and outer layers 44*a*, 44*b* is prevented from entering the passenger area via the hooks and loops 70*a, b* to keep the passenger area and the passengers dry.

The water guard 66 may include a track 74 and a flashing 76. By way of example and not limitation, the flashing 76 may be fabricated from a vinyl material, fabric material, plastic material, SUNBRELLA fabric, SUNBRELLA acrylic canvas, STAMOID vinyl or other flexible material. The flashing 76 may be removeably attachable to the track 74 and the window 26. More particularly, the flashing 76 may be removeably attachable to the inner layer 44*a* via the hooks and loops 70*a* attached to the interior side 68 of the inner layer 44*a* and complementary hooks and loops 70*b* attached along the entire length of the exterior side 72 (see FIGS. 3 and 3*a*).

The flashing 76 may be removeably attachable to the track 74 via a bar 78 and complementary receiving cavity 80 of the track 74. More particularly, the track 74 may have a C shaped cross section which may define the complementary receiving cavity 80. The flashing 76 may be attached to the bar 78 and the bar 78 may be removeably insertable into the complementary receiving cavity 80. By way of example and not limitation, the receiving cavity 80 may have a circular configuration and the bar 78 which may be round may be slid into or snapped into the receiving cavity 80. Accordingly, the flashing 76 may be inserted or snapped into the receiving cavity 80 to engage the flashing 76 to the track 74. The flashing 76 when engaged to the track 74 may extend towards the passenger area and bend upwards, as shown in FIG. 3. Alternatively, as shown in FIG. 3*a*, the flashing 76 when engaged to the track 74 may extend away from the passenger area then upwards and towards the passenger area to form an S-shaped configuration. The hooks and loops 70*b* attached to the flashing 76 may engage the hooks and loops 70*a* of the inner layer 44*a*. Hence, water that may be splashed upwards and under the inner layer 44*a* will be repelled back into the ocean, river or bay via the engagement of the hooks and loops 70*a, b*.

The track 74 may be fabricated from a metallic or preferably, a plastic material. The C shaped cross section of the track 74 may be attached to a base 82. The base 82 may extend the entire length of the track 74. Along the length of the base 82, holes 84 may be formed to receive anchors (not shown) such as screws such that the track 74 may be attached or screwed onto the boat 12. When the tracks 74 are attached to the boat 12, the receiving cavity 80 may be directed inward toward the passenger area, as shown in FIG. 3. Preferably, as shown in FIG. 3*a*, the receiving cavity 80 is directed outward away from the passenger area to further direct rain water away from the passenger area and into the water.

In another aspect of the present invention, a method of fabricating the window 26 is provided. In particular, the transparent sheet 40 is provided through which the boat passengers may view the surrounding scenery once the window system is assembled. The transparent sheet 40 may be interposed between a plurality of inner and outer layers 44, 46 which may surround the entire perimeter/border 42 of the sheet 40. The inner layers 44 may be fabricated from four individual pieces and the outer layers 46 may be fabricated from four individual pieces. Once the sheet 40 is interposed between the inner and outer layers 44, 46, the inner and outer layers 44, 46 are sown onto the sheet 40, as shown in FIGS. 1, 2 and 4. By way of example and not limitation, the inner and outer layers 44, 46 may be sown to the sheet 40 via a run stitch 84 (see FIG. 2) with Tenera Gore-Tex thread or a marine thread. The stitch 84 may be close to the edge of the sheet but preferably does not nick the sheet edge. Also, the stitch 84 may be sufficiently spaced from the edges of the inner and outer layer 44, 46 such that the layers 44, 46 do not rip off of the sheet 40. It is also contemplated within the scope of the present invention that various other types of stitches may be employed to sow the inner and outer layers 44, 46 to the sheet.

The inner and outer layers 44, 46 attached to the vertical edge portions 48*a, b* may further have zippers 54 attached or sown thereto. The zipper 54 may extend along the entire length of the inner and outer layers 44, 46 attached to the vertical edge portions 48*a, b*. The zipper 54 may have a first row of teeth 52 and an attachment base 86. The attachment base 86 may be interposed between the inner and outer layers 44, 46 and sown thereto.

The retaining loops 30 may be attached or sown to the inner and outer layers 44, 46 attached to the sheet upper edge portion 50*b*. The retaining loops 30 may be a flexible material or fabric which may be threaded through a turn buckle 58 and closed upon itself so as to form a loop. At least two retaining loops 30 may be sown to the inner and outer layers 44, 46 attached to the sheet upper edge portion 50*b*. The retaining loop 30 may be a strip with a set of hooks and loops 70 on one side of the strip and a turn buckle through which the strip may be passed through such that the hooks and loops 70 may be engaged to each other. Accordingly, during assembly of the cabin enclosure 10, the strip may be looped around the header 20, passed through the turn buckle 58 and locked into position by engaging the hooks and loops 70.

Inner and outer layers 44, 46 may also be attached or sown to the lower edge portion 50*a* of the sheet 40. More particular, the sheet 40 may be interposed between the inner and outer layers 44, 46 and sown thereto. A set of hooks and loops 70*a* may be attached or sown to the entire length of the inner layer 44, and more particularly, the lower rail 36 of the window 26. Accordingly, during assembly of the cabin enclosure 10, the hooks and loops 70*b* may engage the hooks and loops 70*a*.

In another aspect of the present invention, a method of opening the window 26 is provided. With the cabin enclosure 10 assembled and the windows 26 placed in a closed position, the zippers 54 may be unzipped. Thereafter, the hooks and loops 70*a* may be detached from the hooks and loops 70*b* by pulling or pushing the lower rail 36 outwardly. For example, the horizontal edge portion 50*a* and more particularly, the lower rail 36 may be pulled outward such that the hooks and loops 70*a* disengage the hooks and loops 70*b*. Thereafter, the window 26 may be pushed inward toward the passenger area. Since the retaining loops 30 are engaged to the header 20 and the window 26 is pivotable thereabout, the window 26 may be swung upwards toward the beams 22 of the frame 14. With the window 26 pushed upward so that it is approximately in a horizontal position, the bungee cord 34 (see FIG. 4) attached to the window 26 may be wrapped around a button 38 attached to the beam 22 to hold the window 26 in the opened position.

In another aspect of the present invention, a method of closing the window 26 is provided. With the window 26 pushed upward so that it is approximately in a horizontal position and held in that position by the bungee cord 34, the bungee cord 34 may be unwrapped from the button 38. The window 26 may be guided downward such that it is disposed within the window opening 24 and hanging from the header 20 via the retaining loops 30. The adjacent zippers 54 may be zipped and the hooks and loops 70*a* and 70*b* may be engaged to each other.

This description of the various embodiments of the present invention is presented to illustrate the preferred embodiments of the present invention, and other inventive concepts may be otherwise variously embodied and employed. The appended claims are intended to be construed to include such variations except insofar as limited by the prior art.

What is claimed is:

1. A cabin enclosure for a boat, the cabin enclosure comprising:

a frame circumscribing and covering a passenger area of the boat, the frame having a plurality of window openings and defining a header;

a top attached on the frame and extending beyond the header to allow water to cascade down the top and back into the water;

a plurality of transparent sheets, one of the plurality of transparent sheets disposable within one of the plurality of window openings, each transparent sheet defining two vertical edge portions;

a pair of zippers, one of the pair of zippers disposed adjacent to one of the two vertical edge portions, the other one of the pair of zippers disposed adjacent to the other one of two vertical edge portions;

inner and outer layers with the one of the plurality of transparent sheets and the one of the pair of zippers interposed between the inner and outer layers;

threads pierced through the plurality of inner and outer layers, the one of the pair of zippers and the one of the plurality of transparent sheets;

a water guard attachable to the boat and a flashing attachable to the water guard wherein bottom ends of the inner and outer layers extend outboard of the water guard to allow water to cascade down an exterior side of the one of the transparent sheets and onto an exterior of the boat.

2. The enclosure of claim 1 wherein the water guard and the transparent sheet are removably attachable to each other with hooks and loops.

3. A cabin enclosure for a boat, the cabin enclosure comprising:

a frame circumscribing and covering a passenger area of the boat, the frame having a plurality of window openings and defining a header;

a top attached on the frame and extending beyond the header to allow water to cascade down the top and back into the water;

a plurality of transparent sheets, one of the plurality of transparent sheets disposable within one of the plurality of window openings, each sheet defining two vertical edge portions;

a pair of zippers, one of the pair of zippers disposed adjacent to one of the two vertical edge portions, the other one of the pair of zippers disposed adjacent to the other one of the two vertical edge portions;

inner and outer layers with the one of the plurality of transparent sheets and the one of the pair of zippers interposed between the inner and outer layers;

threads pierced through the inner and outer layers, the one of the pair of zippers and the one of the transparent sheets;

an elastic cord attached to the one of the transparent sheets and a button attached to the frame, and wherein the one of the transparent sheets is rotatably displaceable away from one of the window openings about the header and the elastic cord is engageable with the button to hold the one of the transparent sheets in an opened position.

* * * * *